US006061844A

United States Patent [19]

Barton

[11] Patent Number: 6,061,844

[45] Date of Patent: May 16, 2000

[54] WATER-CONSERVING TOILET HAVING INDEPENDENTLY FLUSHABLE MAIN AND URINAL BOWLS

[76] Inventor: Donn Barton, 217 Hollister Way North, Glastonbury, Conn. 06033

[21] Appl. No.: 09/238,283

[22] Filed: Jan. 28, 1999

[51] Int. Cl.[7] ..... E03D 9/00

[52] U.S. Cl. ..... 4/341; 4/340; 4/353

[58] Field of Search ..... 4/340, 341, 342, 4/345, 363, 353

[56] References Cited

U.S. PATENT DOCUMENTS

| | | | |
|---|---|---|---|
| D. 283,834 | 5/1986 | Grudzinskas | 4/341 X |
| 1,056,361 | 3/1913 | Podmore | 4/341 |
| 1,519,112 | 12/1924 | Burger | 4/341 |
| 3,186,007 | 6/1965 | Falotico | 4/327 |
| 3,336,602 | 8/1967 | Kubit | 4/341 |
| 3,735,428 | 5/1973 | Olivero | 4/341 |
| 3,879,768 | 4/1975 | Murphy | 4/353 X |
| 3,906,554 | 9/1975 | Johnson | 4/327 |
| 3,979,781 | 9/1976 | Jolicoeur | 4/341 |
| 4,174,589 | 11/1979 | Daharsh | 4/353 X |
| 4,197,598 | 4/1980 | Lemmon | 4/341 X |
| 5,301,374 | 4/1994 | Smiley | 4/341 |
| 5,305,475 | 4/1994 | Jaeckels et al. | 4/345 X |
| 5,448,784 | 9/1995 | Smiley | 4/341 |
| 5,548,850 | 8/1996 | Geeham | 4/363 X |
| 5,799,340 | 9/1998 | Hubrig et al. | 4/342 |

*Primary Examiner*—Robert M. Fetsuga
*Attorney, Agent, or Firm*—McCormick, Paulding & Huber LLP

[57] ABSTRACT

Disclosed is an improved water-conserving toilet having independently flushable main and urinal bowls, a water storage tank for storing water for flushing the bowls, and a manually operable flush assembly for flushing the urinal bowl. The flush assembly includes a pump mounted within the water storage tank and a manually operable handle accessible external to the water storage tank. The pump is in fluid communication with the water storage tank and the urinal bowl for pumping a selected amount of water from the water storage tank to the urinal bowl for flushing the urinal bowl upon manual operation of the handle.

7 Claims, 3 Drawing Sheets

WATER-CONSERVING TOILET HAVING INDEPENDENTLY FLUSHABLE MAIN AND URINAL BOWLS

FIELD OF THE INVENTION

This invention relates to a water-conserving toilet, and, more particularly, to a water-conserving toilet having independently flushable urinal and main bowls.

BACKGROUND OF THE INVENTION

Water-conserving toilets are known in the art. One known type of water-conserving toilet is a "dual-flush" toilet, that is, a toilet that provides independently flushable urinal and main bowls for the disposal of liquid and solid wastes, respectively. The flushing apparatus associated with the urinal bowl, which is typically smaller than the main bowl, uses less water than that plumbed to the main bowl, hence saving water as compared to a one-bowl toilet that is flushed with the same volume of water, regardless of whether solid or liquid waste are to be flushed. Known dual-flush toilets, however, tend to be unduly complex, particularly with respect to the apparatus for flushing the urinal bowl.

U.S. Pat. No. 3,906,554, for example, discloses a dual-flush toilet that releases different amounts of flush water depending on whether solids or liquids are being flushed. Separate handles are provided for flushing the urinal and main bowls, each handle activating a different chain mechanism and cylindrical flush mechanism. This toilet is rather complex, appears to use more water than necessary to flush the urinal bowl, and the chain-pull system mechanism allows a user to waste water by simply holding the flush lever down.

Other dual-flush toilets use electric or manual valves connected to the water supply line to flush the urinal bowl. For example, disclosed in U.S. Pat. No. 5,448,784 is an electric solenoid that controls a valve for flushing the urinal bowl with water obtained directly from the water supply line. The performance of this system, and in particular the volume of water dispensed to flush the urinal bow, can vary due to variation in the pressure of the water in the supply line. Water from home well systems is typically supplied at a pressure that can vary during the drawing of the water from the well from between 25 and 60 or 70 psi, while municipal water can be supplied at pressures as high as 100 psi. Furthermore, such a toilet can be unsuitable for locations where electrical power is not provided, such as campsites, cottages, or the like.

As another example, disclosed in U.S. Pat. No. 5,301,374 is a manual valve connected to the water supply line for flushing the urinal bowl. Although this valve does not require electricity, it is subject to the drawbacks noted above regarding the use of water from the water supply line, can require intricate plumbing connections and components, and it, too, can be held open, wasting water.

Accordingly, it is an object of the present invention to address these and other drawbacks of the prior art, and to provide a simpler dual-flush toilet.

SUMMARY OF THE INVENTION

In one aspect, the invention provides an improved water-conserving toilet having independently flushable main and urinal bowls and a water storage tank for storing water for flushing the bowls. The improvement includes a manually operable flush assembly for flushing the urinal bowl. The flush assembly includes a pump mounted within the water storage tank and a manually operable handle accessible external to the water storage tank. The pump is in fluid communication with the water storage tank and the urinal bowl for pumping a selected amount of water from the water storage tank to the urinal bowl for flushing the urinal bowl upon manual operation of the handle.

In other aspects of the invention, the pump can include an internal bore in fluid communication with the interior of the tank and with the urinal bowl and a piston slidably disposed within the bore. The manually operable handle is coupled to the piston for sliding the piston for displacing water from the bore for flushing the urinal bowl. The pump can further include a pump base secured to the tank, a pump lid, a pull rod, and an extended pump housing substantially defining the bore, where the housing engages at a first end thereof the pump base and at a second end thereof the pump lid, and the pull rod couples the handle and the piston and extends through the pump lid.

The pump can also include a one-way valve that includes a passage extending through the piston along the bore, and a flexible valve element disposed with the piston for preventing fluid flow in one direction through the passage and allowing fluid flow in the opposite direction through the passage. The pump can be oriented vertically such that sliding the piston upward displaces water from a first bore volume above the piston for flushing the urinal bowl and draws water from the tank into second bore volume below the piston. The piston can be weighted such that, after release of the handle by a user, it is urged by gravity to travel downwardly. The one way valve passes fluid from the second bore volume to the first bore volume, filling the second bore volume and facilitating the downward travel of the piston. The invention thus advantageously provides an improved dual-flush toilet having a manually operable flush assembly for flushing the urinal bowl with predetermined amount of water that does not vary depending on water pressure, or on the amount of time a flush lever is actuated. Furthermore, operation of the invention need not require electricity. A minimal amount of water can be repeatably dispensed with each flush for enhancing water conservation. The flush assembly can easily manufactured and operated, and the amount of water used to flush the urinal bowl can readily be changed.

BRIEF DESCRIPTION OF THE DRAWINGS

Other objects, features, and advantages will be apparent from the following description of preferred embodiments and the accompanying drawings, in which.

DETAILED DESCRIPTION OF THE PREFERRED EMBODIMENTS

Figure 1:
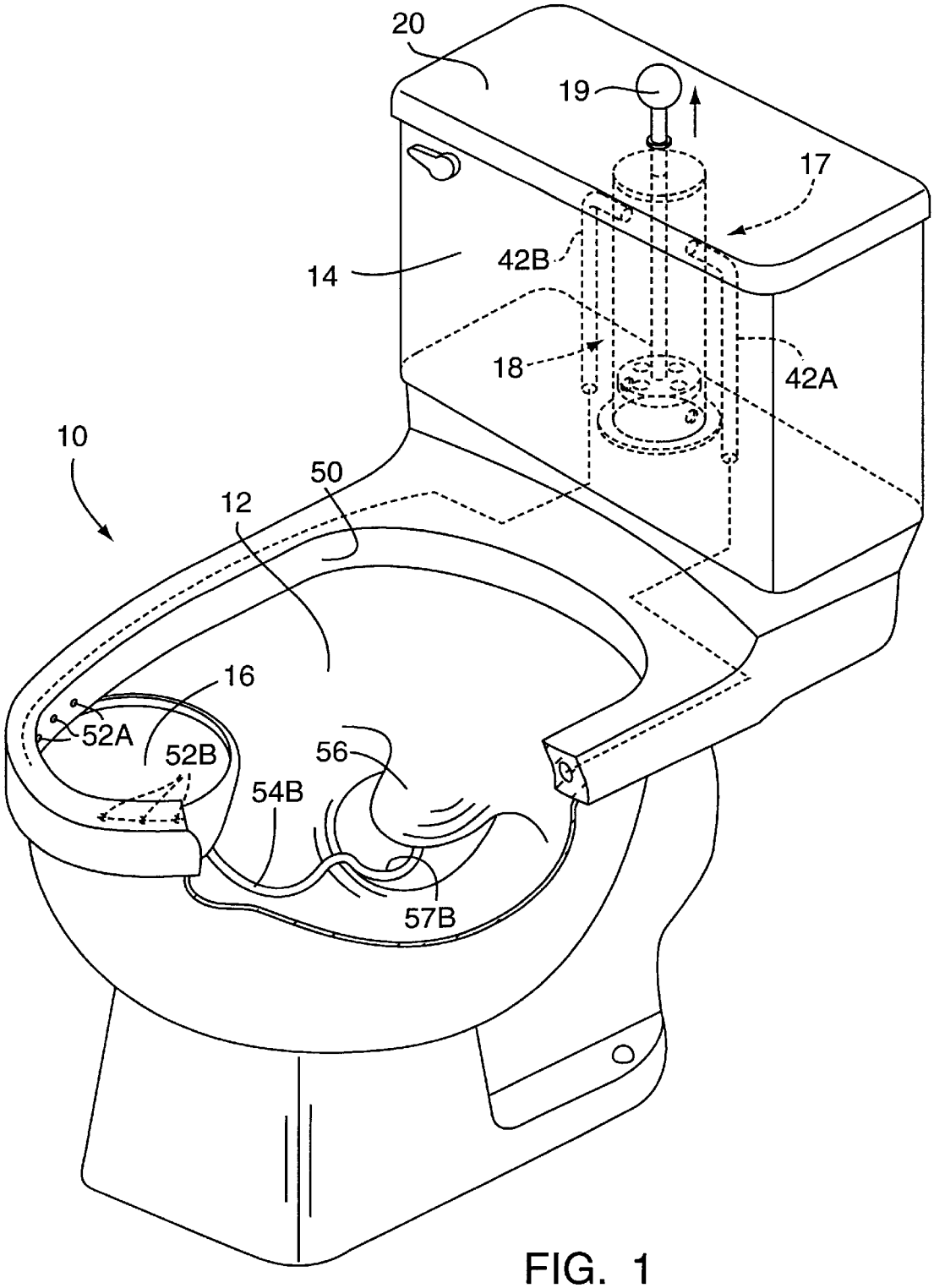
FIG. 1 is a partly cross sectional, partly perspective view of the improved toilet according to the invention.

Referring to FIG. 1, a toilet 10 includes a main bowl 12, a water storage tank 14, a urinal bowl 16, and a manually operable flush assembly 17 that includes a pump assembly 18 having a handle 19. The water storage tank 14 holds water for flushing the main and urinal bowls, 12 and 16, respectively, and supports a tank lid 20. The pump 18 is vertically oriented such that a user can flush the urinal bowl 16 by moving the pump handle 19 upwards. For clarity, neither a main bowl flush assembly for flushing the main bowl 12 nor the apparatus for maintaining a selected volume of water in the storage tank 14 are shown in FIG. 1. Such apparatus is well known in the art, and the present invention is not intended to be dependent on the type of apparatus used for flushing the main bowl 12 or for maintaining water in the storage tank 14.

Figure 2:
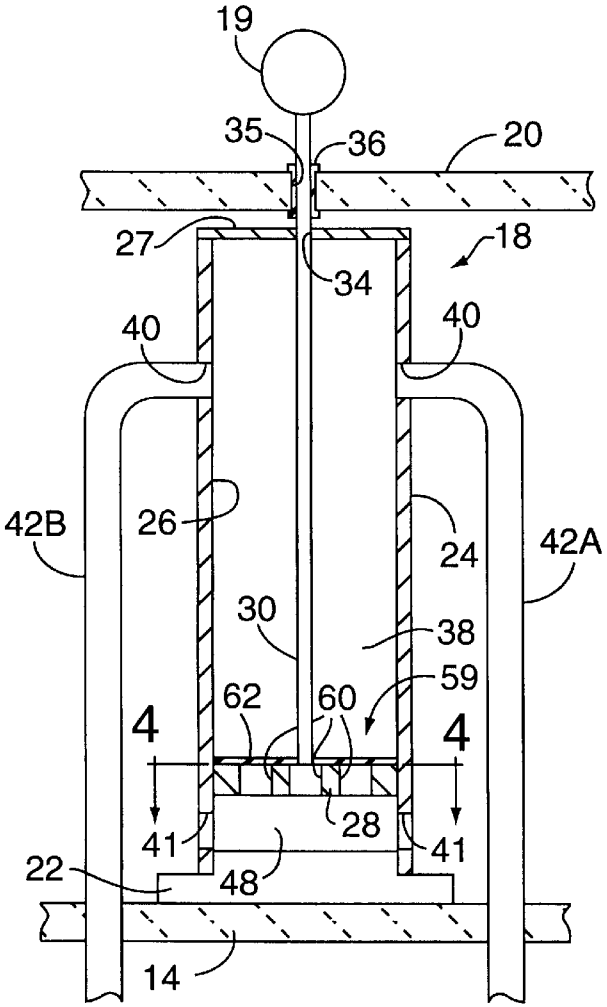
FIG. 2 is an enlarged cross sectional view of the pump assembly of the improved toilet of FIG. 1.

FIG. 2 is a cross sectional view of the pump 18 of the improved toilet 10 of FIG. 1. The bottom of the water storage tank 14 mounts the pump base 22 of a pump assembly 18, the pump base in turn mounting the pump housing 24, which forms the bore 26 of a pump 18. The pump housing 24 can include outer threads at the bottom thereof for mating with inner threads of the pump base 22, and inner threads at the upper end for receiving threads on a pump lid 27 (threads not shown). A piston 28 is slidably disposed within the bore 26 and is secured to one end of a pull rod 30, with the handle 19 fixed to the other end of the pull rod 30. Apertures 34 and 35, in the pump lid 27 and tank lid 20, respectively, receive the pull rod 30, and a seal 36 is disposed within the tank lid aperture 35 to inhibit leakage along the pull rod 30.

Figure 3:
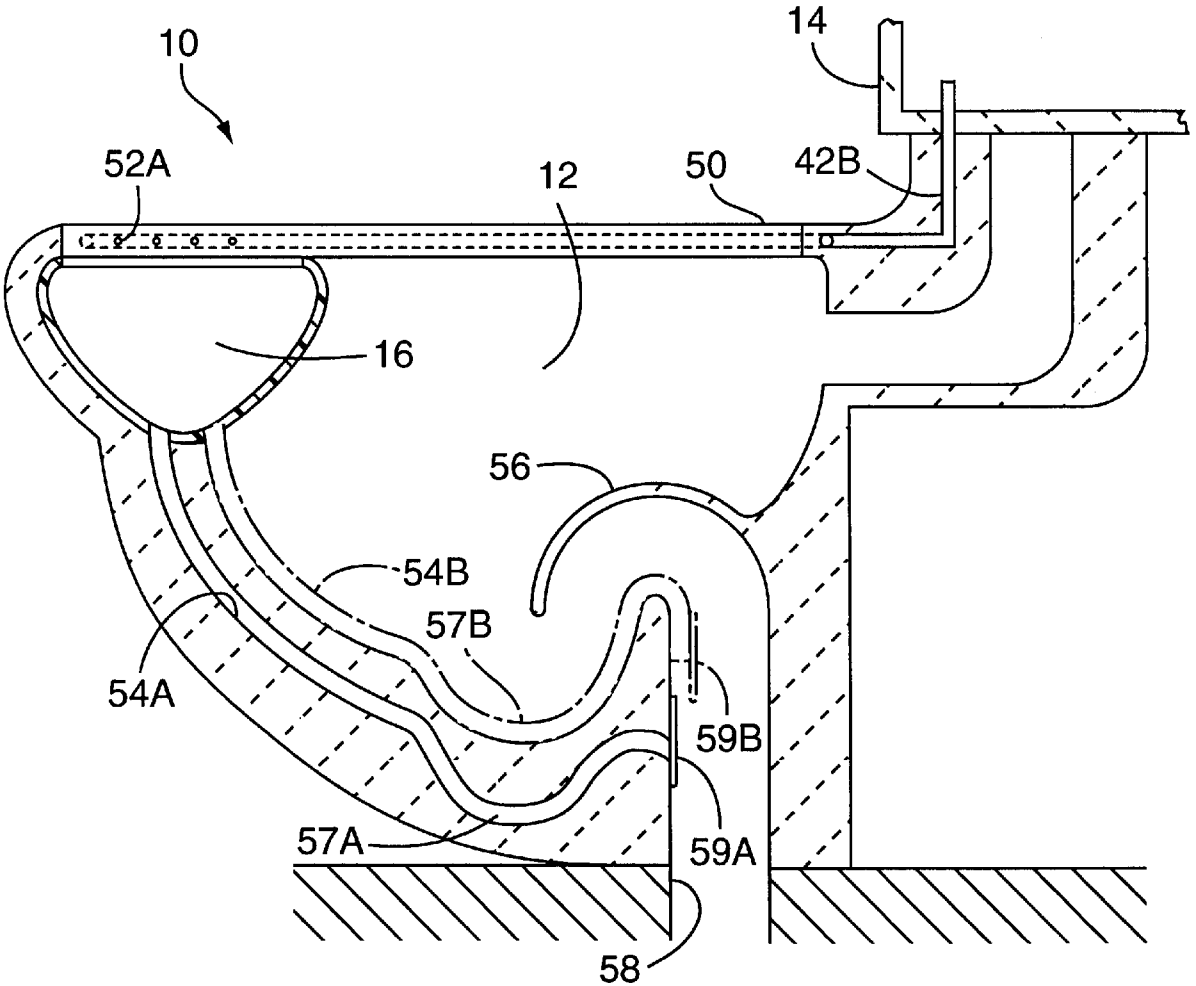
FIG. 3 is a cross sectional view of the main and urinal bowls of the improved toilet of FIG. 1.

The piston 28 divides the bore 26 into a first bore volume 38, located above the piston 28 and in fluid communication with the urinal bowl 16 via escape holes 40 and flush conduits 42A and 42B, and a second bore volume 48 below the piston 28, and which is in fluid communication with the storage tank 14 via holes 41. Pulling the handle 19 upward moves the piston 28 upward, forcing a flushing fluid, e.g., water, out of the escape holes 40 for flushing the urinal bowl 16 while drawing water from the storage tank 14, via the holes 41, for filling the second bore volume 48. As shown in FIG. 3, the flush conduits 42A and 42B are routed around the sides of the toilet rim 50 and include, respectively, water diffuser holes 52A and 52B, for flushing each side of the urinal bowl 16, as is also shown in FIG. 1. Water coats the urinal bowl 16, then flushes the contents down the drain tube conduit 54A, through a trap portion 57A and into a sewer line 58. Preferably, the drain conduit 54A is formed within the fixture, typically porcelain, that defines the main bowl 12, as illustrated in FIG. 3. A shroud 59A prevents the outlet of the conduit 54A from becoming clogged with solid waste. Optionally, an external conduit 54B can convey the contents of the urinal bowl 16 to the sewer line 58. The external conduit 54B can be a plastic tube, and is typically used when retrofitting an existing single flush toilet. The external conduit 54B forms a trap portion 57B where the conduit 54B bends around the main trap 56. The shroud 59B performs the same function as the shroud 59A.

Figure 6:
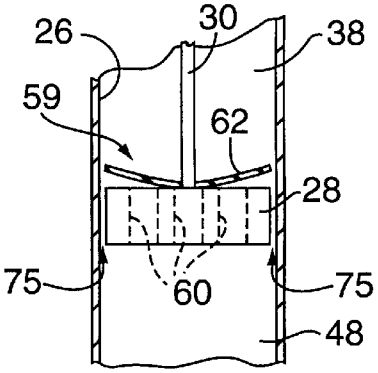
FIG. 6 is an enlarged view of the piston assembly of FIG. 2 showing the valve element flexed away from the piston for allowing flow through the passages.
Figure 4:
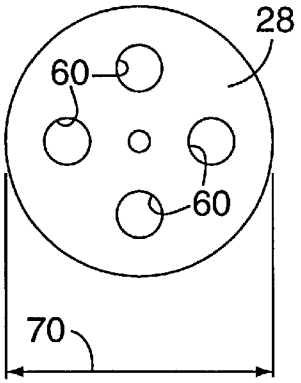
FIG. 4 is a cross sectional view, taken along the section line 4—4 of FIG. 2, of the piston of FIG. 2.
Figure 5:
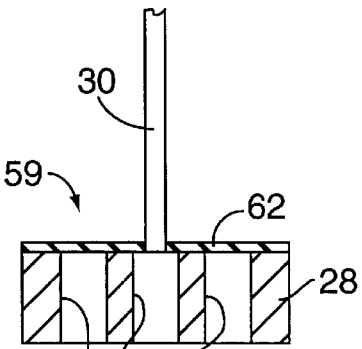
FIG. 5 is a enlarged view of the piston assembly of FIG. 2, showing the piston, passages therethrough, and the valve element disposed with the piston.

As seen in FIGS. 4–6, the piston 28 can be part of a piston assembly 59 that includes a one way valve formed by an array of passages 60 that pass through the piston 28 in a direction along the bore and a valve element 62. The one-way valve allows water to pass from the second bore volume 48 to the first bore volume 38, but blocks flow in the other direction. For example, as the pullrod 30 pulls the piston 28 upward, the valve element 62 is forced against the piston and prevents water from moving through the passages 60. When the piston 28 reaches the upmost end of its travel in the bore 26, the handle 19 (shown in FIG. 2) is released. The piston 28 can be weighted such that gravity pulls the piston 28 downward with sufficient force to force the one way valve open, e.g., the valve element 62 is flexed away from the piston 28, as shown in FIG. 6, such that the passages 60 allow fluid flow from the second bore volume 48 to the first bore volume 38, facilitating the downward displacement of the piston 28 and adding water to the first bore volume 38. The piston 28 comes to rest at the bottom of the bore 26.

Preferably, the pump 18 delivers between 75 and 200 milliliters (ml) water to the urinal bowl 16 per flush; more preferably the pump delivers between 75 and 150 ml of water to the urinal bowl 16 per flush, and most preferably, the pump delivers approximately 100 ml to the urinal bowl 16 per flush. Unlike the typical main bowl 12, the urinal bowl does not maintain a constant level of water in the bowl, and is usually empty. In one embodiment, the piston 28 is a metal disc having a diameter (indicated by reference numeral 70 in FIG. 4) of approximately 1 cm and travels approximately 50 cm along the bore 26. The amount of water flushed can be varied by changing the length of the pull rod 30.

The urinal bowl 16, drain tube 54 and main bowl 12 can form a unitary structure, typically of porcelain, or, alternatively, the urinal bowl 16 and drain tube 54 can be made of plastic and fitted to a porcelain main bowl 12. The urinal bowl 16, as well as the drain tube 54, can be adapted for removable and replaceable installation with the main bowl 12. For example, the urinal bowl 16 can be held into the main bowl 12 using a stainless steel wire cage (not shown) that supports the bowl 16 and fits over the rim of the main bowl 12.

It will thus be seen that the invention efficiently attains the objects set forth above, among those made apparent from the preceding description. Because certain changes may be made in the above constructions without departing from the scope of the invention, it is intended that all matter presented in the above description or shown in the accompanying drawings be interpreted as illustrative and not as limiting. For example, as understood by one of ordinary skill in the art, in light of the disclosure herein, other types of manual pumps, such as a rotary pumps, or bladder-type pumps that pump fluid by compressing a refillable bladder, are known in the art, and such variations are considered within the scope of the invention. As understood by one of ordinary skill, the pump need not be oriented vertically, and furthermore, the one-way valve can be independent of the piston 28, obviating the need for passages 60 in the piston 28. For example, the one way valve can be disposed in an external 24 fluid interconnection, such as in tubing, between the bottom and top of the bore 26. Alternatively, the piston 28 may be loosely fitted to the bore 26 such that rapid movement of the piston 28 upward flushes most of the water from the first bore volume 38 to urinal bowl 16, yet sufficient water flows through gaps 75 in FIG. 6 between the piston 28 and the bore 26 for the piston to travel downwardly to the bottom of the bore 26 after release of the handle 19 after flushing, thereby filling the first bore volume 38 with water.

It is also understood that the following claims are to cover all generic and specific features of the invention described herein, and all statements of the scope of the invention which as a matter of language, might be said to fall therebetween.

What is claimed is:

1. In a water-conserving toilet having independently flushable main and urinal bowls and a water storage tank for storing water for flushing the bowls, the improvement comprising:

a manually operable flush assembly for flushing said urinal bowl, said flush assembly including a pump mounted within said water storage tank and having a manually operable handle accessible external to said water storage tank, said pump in fluid communication with said water storage tank and said urinal bowl for pumping a selected amount of water from said water storage tank to said urinal bowl for flushing said urinal bowl upon manual operation of said handle.

2. In the water-conserving toilet of claim 1, the further improvement wherein said pump forms an internal bore in fluid communication with the interior of said tank and with said urinal bowl, said pump further including a piston slidably disposed within said bore, and wherein said manually operable handle is coupled to said piston for sliding said piston for displacing water from said bore for flushing said urinal bowl.

3. In the water-conserving toilet of claim 2, the further improvement wherein said pump further includes a pump base secured to said tank, a pump lid, a pull rod, and an extended pump housing substantially defining said bore, said housing engaging at a first end thereof said pump base and at a second end thereof said pump lid, said pull rod coupling said handle and said piston and extending through said pump lid, and including at least one passage extending through said piston and a flexible valve element disposed with said piston for preventing fluid flow in one direction through said at least one passage and allowing fluid flow in the opposite direction through said at least one passage, and wherein said piston is weighted so as to be urged by gravity to travel downwardly with sufficient force such that said valve element flexes for allow passage of water through said at least one passage.

4. In the water-conserving toilet of claim 2, the further improvement wherein said piston divides said bore into a first bore volume in fluid communication with said urinal bowl and a second bore volume in fluid communication with tank, and wherein said flush assembly includes a one-way valve for allowing fluid transfer from said second bore volume to said first bore volume and for blocking fluid transfer from said first bore volume to said second bore volume.

5. In the water-conserving toilet of claim 4, the further improvement wherein said bore extends substantially vertically such that said second bore volume is the lower of the bore volumes, and wherein said piston is weighted so as to be urged by gravity to travel downwardly with sufficient force for having said one-way valve pass fluid after release of said handle after flushing of said urinal bowl via upward displacement of said piston by upward movement of said handle.

6. In the water-conserving toilet of claim 5, the further improvement wherein said one way valve includes a passage defined by said piston and a flexible valve member mounted with said piston for flexing away from said passage allowing fluid transfer from said second bore volume to said first bore volume and for blocking said passage for blocking fluid transfer from said first bore volume to said second bore volume.

7. In the water-conserving toilet of claim 4, the further improvement wherein said first bore volume is bounded in part by a first surface of said piston, said piston defining at least one passage therethrough forming an aperture in said first surface of said piston, said flush assembly including a flexible valve element disposed with said piston for blocking said aperture so as to prevent fluid flow from said first bore volume to said second bore volume during actuation of said pump to flush said urinal bowl, and for exposing said aperture for allowing fluid flow from said second bore volume to said first bore volume when said piston is displaced so as to increase said first bore volume and decrease said second bore volume.

* * * * *